US005860731A

United States Patent [19]

Martinez

[11] Patent Number: 5,860,731

[45] **Date of Patent: *Jan. 19, 1999**

[54] CHRISTMAS LIGHT ARRANGEMENT

[76] Inventor: Lannette Ann Martinez, 17687 San Diego Cir., Fountain Valley, Calif. 92708

[ * ] Notice: This patent issued on a continued prosecution application filed under 37 CFR 1.53(d), and is subject to the twenty year patent term provisions of 35 U.S.C. 154(a)(2).

[21] Appl. No.: 899,067

[22] Filed: Jul. 23, 1997

[51] Int. Cl.[6] ..... F21P 1/00

[52] U.S. Cl. ..... 362/252; 362/249; 362/391; 362/806; 362/145

[58] Field of Search ..... 362/249, 238, 362/252, 806, 391, 396, 145

[56] References Cited

U.S. PATENT DOCUMENTS

| | | | |
|---|---|---|---|
| 3,704,365 | 11/1972 | Miller | 362/806 |
| 5,150,964 | 9/1992 | Tsui | 362/251 |
| 5,559,681 | 9/1996 | Duarte | 362/252 |

*Primary Examiner*—Stephen F. Husar

[57] ABSTRACT

A Christmas light arrangement including a central string of wire having a plurality of lights disposed thereon in a spaced relationship. A plurality of supplemental strings of wire are provided with each having a plurality of lights disposed thereon in a spaced relationship. The plurality of supplemental strings are coupled with the central string of wire in a spaced relationship. A plurality of securement mounts are positioned in a spaced relationship with respect to the central string of wire.

4 Claims, 2 Drawing Sheets

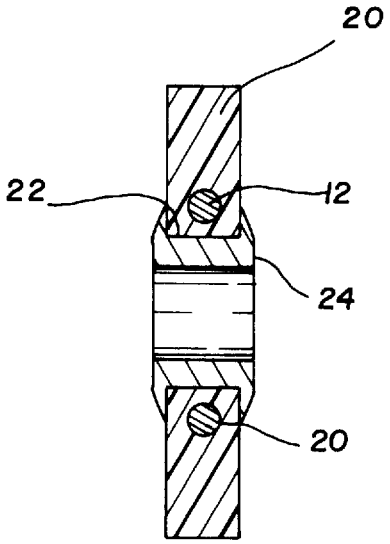
FIG. 3
FIG. 4
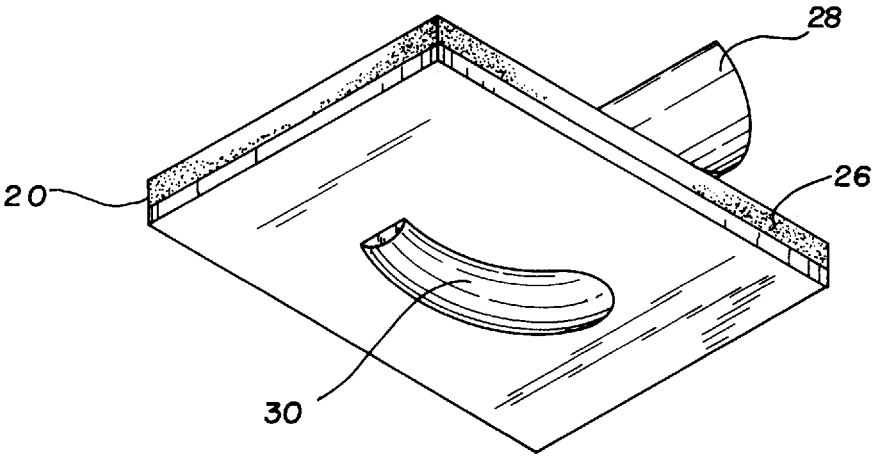

CHRISTMAS LIGHT ARRANGEMENT

BACKGROUND OF THE INVENTION

1. Field of the Invention

The present invention relates to a Christmas light arrangement and more particularly pertains to simulating the appearance of icicles on a house with a Christmas light arrangement.

2. Description of the Prior Art

The use of Christmas lights is known in the prior art. More specifically, Christmas lights heretofore devised and utilized for the purpose of decorating Christmas trees are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,057,976 to DuMong; U.S. Pat. No. 5,422,801 to Sangalli, Jr.; U.S. Pat. No. Des. 358,673 to Thompson; U.S. Pat. No. 5,141,192 to Adams; U.S. Pat. No. 5,024,406 to Ketcham; and U.S. Pat. No. 5,245,519 to Openiano.

While these devices fulfill their respective, particular objective and requirements, the aforementioned patents do not describe a Christmas light arrangement for simulating the appearance of icicles on a house.

In this respect, the Christmas light arrangement according to the present invention substantially departs from the conventional concepts and designs of the prior art, and in doing so provides an apparatus primarily developed for the purpose of simulating the appearance of icicles on a house.

Therefore, it can be appreciated that there exists a continuing need for new and improved Christmas light arrangement which can be used for simulating the appearance of icicles on a house. In this regard, the present invention substantially fulfills this need.

SUMMARY OF THE INVENTION

In the view of the foregoing disadvantages inherent in the known types of Christmas lights now present in the prior art, the present invention provides an improved Christmas light arrangement. As such, the general purpose of the present invention, which will be described subsequently in greater detail, is to provide a new and improved Christmas light arrangement and method which has all the advantages of the prior art and none of the disadvantages.

To attain this, the present invention essentially comprises a central string of wire having a plurality of lights disposed thereon in a spaced relationship. A plurality of supplemental strings of wire are provided with each having a plurality of lights disposed thereon in a spaced relationship. The plurality of supplemental strings are coupled with the central string of wire in a spaced relationship. A plurality of securement mounts are positioned in a spaced relationship along the central string of wire. Each of the securement mounts have an aperture therethrough. Each of the apertures has a grommet disposed therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Christmas light arrangement which has all the advantages of the prior art Christmas lights and none of the disadvantages.

It is another object of the present invention to provide a new and improved Christmas light arrangement which may be easily and efficiently manufactured and marketed.

It is a further object of the present invention to provide a new and improved Christmas light arrangement which is of durable and reliable construction.

An even further object of the present invention is to provide a new and improved Christmas light arrangement which is susceptible of a low cost of manufacture with regard to both materials and labor, and which accordingly is then susceptible of low prices of sale to the consuming public, thereby making such a Christmas light arrangement economically available to the buying public.

Even still another object of the present invention is to provide a new and improved Christmas light arrangement for simulating the appearance of icicles on a house.

Lastly, it is an object of the present invention to provide a new and improved Christmas light arrangement including a central string of wire having a plurality of lights disposed thereon in a spaced relationship. A plurality of supplemental strings of wire are provided with each having a plurality of lights disposed thereon in a spaced relationship. The plurality of supplemental strings are coupled with the central string of wire in a spaced relationship. A plurality of securement mounts are positioned in a spaced relationship with respect to the central string of wire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is cross-sectional view as taken along line 3—3 of FIG. 2.

FIG. 4 is perspective view of a second embodiment of the present invention.

The same reference numerals refer to the same parts through the various figures.

DESCRIPTION OF THE PREFERRED EMBODIMENT

Figure 1:
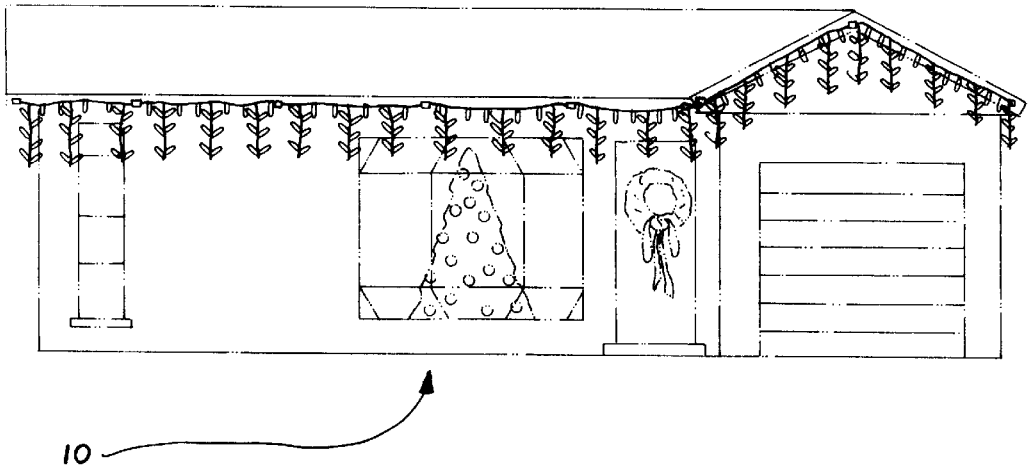
FIG. 1 is a front view of the preferred embodiment of the Christmas light arrangement constructed in accordance with the principles of the present invention.
Figure 2:
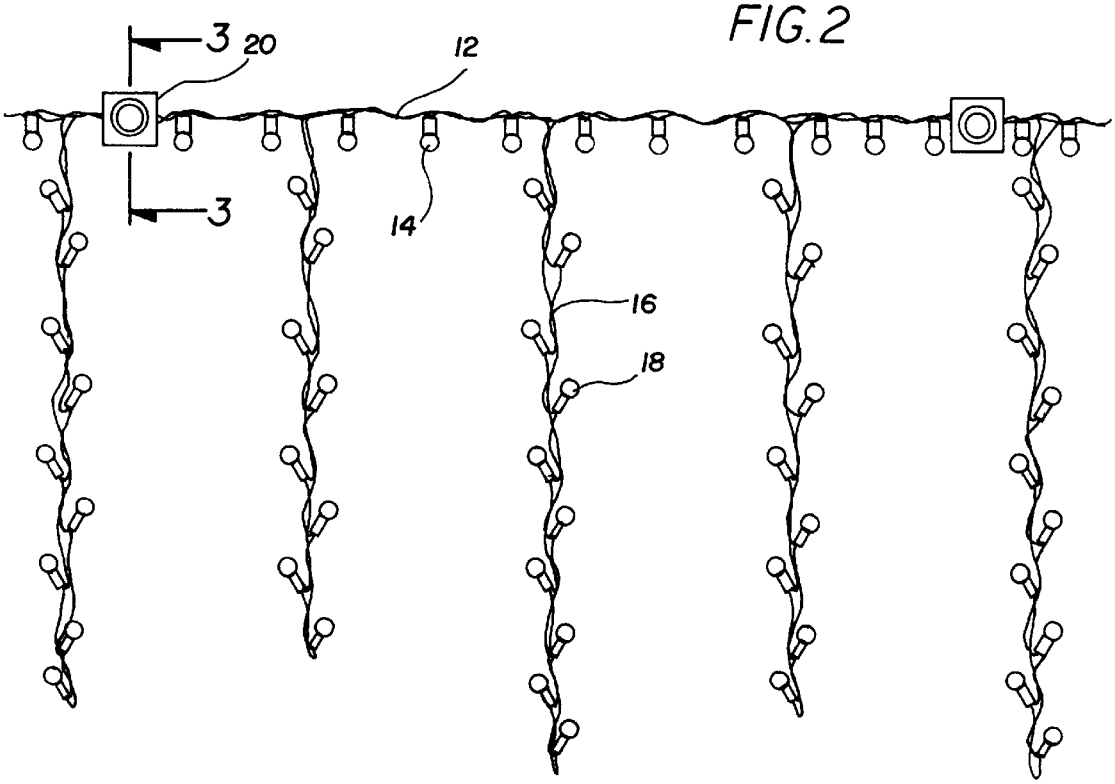
FIG. 2 is an isolated front view of the present invention.

With reference now to the drawings, and in particular, to FIGS. 1 through 4 thereof, the preferred embodiment of the new and improved Christmas light arrangement embodying the principles and concepts of the present invention and generally designated by the reference number 10 will be described.

Specifically, it will be noted in the various Figures that the device relates to a Christmas light arrangement for simulating the appearance of icicles on a house. In its broadest context, the device consists of a central string of wire, a plurality of supplemental wires and a plurality of securement mounts. Such components are individually configured and correlated with respect to each other so as to attain the desired objective.

The central string of wire 12 has a plurality of lights 14 disposed thereon in a spaced relationship.

The plurality of supplemental strings of wire 16 each have a plurality of lights 18 disposed thereon in a spaced relationship. The plurality of supplemental strings 18 are coupled with the central string of wire 12 in a spaced relationship.

The plurality of securement mounts 20 are positioned in a spaced relationship along the central string of wire 12. Each of the securement mounts 20 have an aperture 22 therethrough. Each of the apertures 22 has a grommet 24 disposed therein. In the preferred embodiment, the central string of wire 12 extends through the securement mounts 20 with the wire splitting around the apertures 22 and grommets 24. The apertures 22 and grommets 24 allows for the lights to be secured, with nails or the like, to an outer surface of a house with the supplemental strings 18 hanging downwardly from the central string 12 in a fashion similar to icicles.

A second embodiment of the present invention is shown in FIG. 4 and includes substantially all of the components of the present invention wherein the apertures 22 and grommets 24 of the securement mounts 20 are removed for use indoors. The securement mounts 20 have interior and exterior surfaces. The interior surface has an adhesive 26 disposed thereon. The adhesive 26 is protected prior to use by a protective film 28 that can be peeled away. The adhesive 26 is used to secure the mounts 20 to a wall surface within a house. The exterior surface has a hook 30 disposed thereon for coupling with the central string of wire 12. The central string of wire 12 is simply draped over the hooks 30.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A Christmas light arrangement for simulating the appearance of icicles on a house comprising, in combination:

a central string of wire having a plurality of lights disposed thereon in a spaced relationship;

a plurality of supplemental strings of wire each having a plurality of lights disposed thereon in a spaced relationship, the plurality of supplemental strings coupled with the central string of wire in a spaced relationship; and a plurality of securement mounts positioned in a spaced relationship along the central string of wire, each of the securement mounts having an aperture therethrough, each of the apertures having a grommet disposed therein.

2. A Christmas light arrangement comprising:

a central string of wire having a plurality of lights disposed thereon in a spaced relationship;

a plurality of supplemental strings of wire each having a plurality of lights disposed thereon in a spaced relationship, a plurality of supplemental strings coupled with the central string of wire in a space relationship; and a plurality of securement mounts positioned in a spaced relationship with respect to the central string of wire;

wherein each of the securement mounts receive the central string of wire therethrough, each of the mounts having an aperture therethrough, each of the apertures having a grommet disposed therein.

3. The Christmas tree light arrangement as set forth in claim 2 wherein the securement mounts have interior and exterior surfaces, the interior surface having an adhesive disposed thereon, the exterior surface having a hook disposed thereon for coupling with the central string of wire.

4. A Christmas light arrangement for simulating icicles comprising:

a central string of wire mounted along an upper periphery of a building;

a plurality of supplemental strings of wire each having a plurality of lights disposed thereon in an equally spaced relationship, the plurality of supplemental strings each having a top end coupled with the central string of wire in a spaced relationship and a free bottom end, wherein the supplemental strings depend from the central string in parallel relationship;

wherein the supplemental strings each have a length which is different from that of an adjacent supplemental string so as to depend from the central string varying distances to thereby simulate icicles.

* * * * *